US007445504B1

(12) United States Patent
Zhang

(10) Patent No.: US 7,445,504 B1
(45) Date of Patent: Nov. 4, 2008

(54) ELECTRICAL CONNECTOR WITH SHELL

(75) Inventor: George(Huanyi) Zhang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/900,612

(22) Filed: Sep. 12, 2007

(51) Int. Cl.
*H01R 13/648* (2006.01)

(52) U.S. Cl. ..... 439/607

(58) Field of Classification Search ..... 439/607–610, 439/108

See application file for complete search history.

(56) References Cited

U.S. PATENT DOCUMENTS

| | | | | |
|---|---|---|---|---|
| 5,035,652 | A * | 7/1991 | Shibano | 439/610 |
| 5,102,350 | A * | 4/1992 | Janota et al. | 439/607 |
| 5,800,204 | A * | 9/1998 | Niitsu | 439/495 |
| 6,629,857 | B1 * | 10/2003 | Ma et al. | 439/567 |
| 6,655,992 | B1 * | 12/2003 | Ko | 439/579 |
| 6,685,508 | B2 * | 2/2004 | Zhu et al. | 439/607 |
| 6,796,839 | B1 * | 9/2004 | Wu | 439/607 |
| 7,344,409 | B2 * | 3/2008 | Lang et al. | 439/607 |
| 2004/0018772 | A1 * | 1/2004 | Zhang et al. | 439/607 |
| 2006/0025140 | A1 * | 2/2006 | Bales et al. | 455/445 |
| 2006/0079130 | A1 * | 4/2006 | Zhang et al. | 439/607 |
| 2006/0128219 | A1 * | 6/2006 | Zhang et al. | 439/607 |
| 2006/0160399 | A1 | 7/2006 | Dawiedczyk et al. | |
| 2006/0189180 | A1 * | 8/2006 | Lang et al. | 439/76.1 |
| 2006/0189211 | A1 * | 8/2006 | Lang et al. | 439/607 |
| 2007/0173118 | A1 * | 7/2007 | Chen | 439/607 |
| 2007/0287330 | A1 * | 12/2007 | Chien et al. | 439/607 |
| 2008/0020640 | A1 * | 1/2008 | Zhang | 439/607 |

* cited by examiner

*Primary Examiner*—Alexander Gilman
(74) *Attorney, Agent, or Firm*—Wei Te Chung

(57) ABSTRACT

An electrical connector (100) includes an insulated housing (1), a number of terminals (2) received in the insulated housing (1), a metal shell (3) assembled to the insulated housing (1). The metal shell (3) includes an inverted U-shaped body portion (30), with a substantially U-shaped frame portion connecting to rear edges of transversal walls (32) and a spring member (37) slantways extending downward and rearward from rear edge of an upper wall (31) thereof. The insulated housing (1) is reliably held by the U-shaped frame portion of the metal shell (3), with the body portion (30) located forwardly of the insulated housing (1) and the spring member (37) located above of the insulated housing (1).

20 Claims, 7 Drawing Sheets

ELECTRICAL CONNECTOR WITH SHELL

CROSS-REFERENCE TO RELATED APPLICATION

This application is related to U.S. patent application Ser. No. 11/492,148 filed on Jul. 24, 2006 and entitled "ELECTRICAL CONNECTOR WITH SHELL", and it has the same applicant and assignee as the present invention. The disclosure of the related application is incorporated herein by reference.

BACKGROUND OF THE INVENTION

1. Field of the Invention

The present invention generally relates to an electrical connector, and more particularly to an electrical connector with a metal shell.

2. Description of Related Art

The SFF Committee is an ad hoc group formed to address storage industry needs in a prompt manner. One kind of connector named Mini SAS connector adapted for high-speed transmission has been defined by the SFF Committee. Several types of utility Mini SAS connectors have been launched and U.S. Pub. No. 2006/0160399 A1 discloses such kind of connector. The connector includes a connector guide made of sheet metal and located in front of an insulated housing. The connector guide and the insulated housing are separately mounted on a printed circuit board. When an opposing connector mates with the connector, the connector guide serves to align contact surfaces and provide strain relief to the connector. However, the insulated housing and the connector guider are handled relay on a pick-up cover/device. It is loose to control relative dimension/position therebetween. The aforementioned pending patent application Ser. No. 11/492,148 discloses an insulted housing and a metal shell (connector guide) combined together to form one piece type of electrical connector. A special design of this kind of electrical connector may decrease/eliminate aforesaid problems. Nevertheless, as the metal shell is assembled to the insulated housing via a pair of relative thin and flexible arms, and the insulated housing and the metal shell may not be combined securely, and further the metal shell couldn't withstand big force exerted along mating direction.

Hence, an improved electrical connector with a metal shell is highly desired to overcome the disadvantages of the related art.

SUMMARY OF THE INVENTION

Accordingly, an object of the present invention is to provide an electrical connector with improved structure to make an insulated housing and a metal shell combined more tightly and reliably.

In order to achieve the object set forth, an electrical connector in accordance with the present invention comprises an insulated housing having a primary body portion including a top wall, a bottom wall and a pair of side walls interconnecting with the top wall and the bottom wall to cooperatively form a hollow portion; a plurality of terminals arranged into two distinct sets and respectively supported by the top wall and the bottom wall of the insulated housing; a metal shell including an upper wall and a pair of transversal walls extending downwardly from two opposite side edges of the upper wall to form a substantially inverted U-shaped body portion, said metal shell further having a pair of lateral arms extending rearward from rear edges of the transversal walls respectively and a subsidiary arm coupled to ends of the pair of lateral arms to form a substantially U-shaped frame portion. The insulated housing is securely assembled to the U-shaped frame portion, with the body portion of the metal shell located forwardly of the insulated housing. A spring member slantways extending downward and rearward from rear edge of the upper wall and located above the insulated housing.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
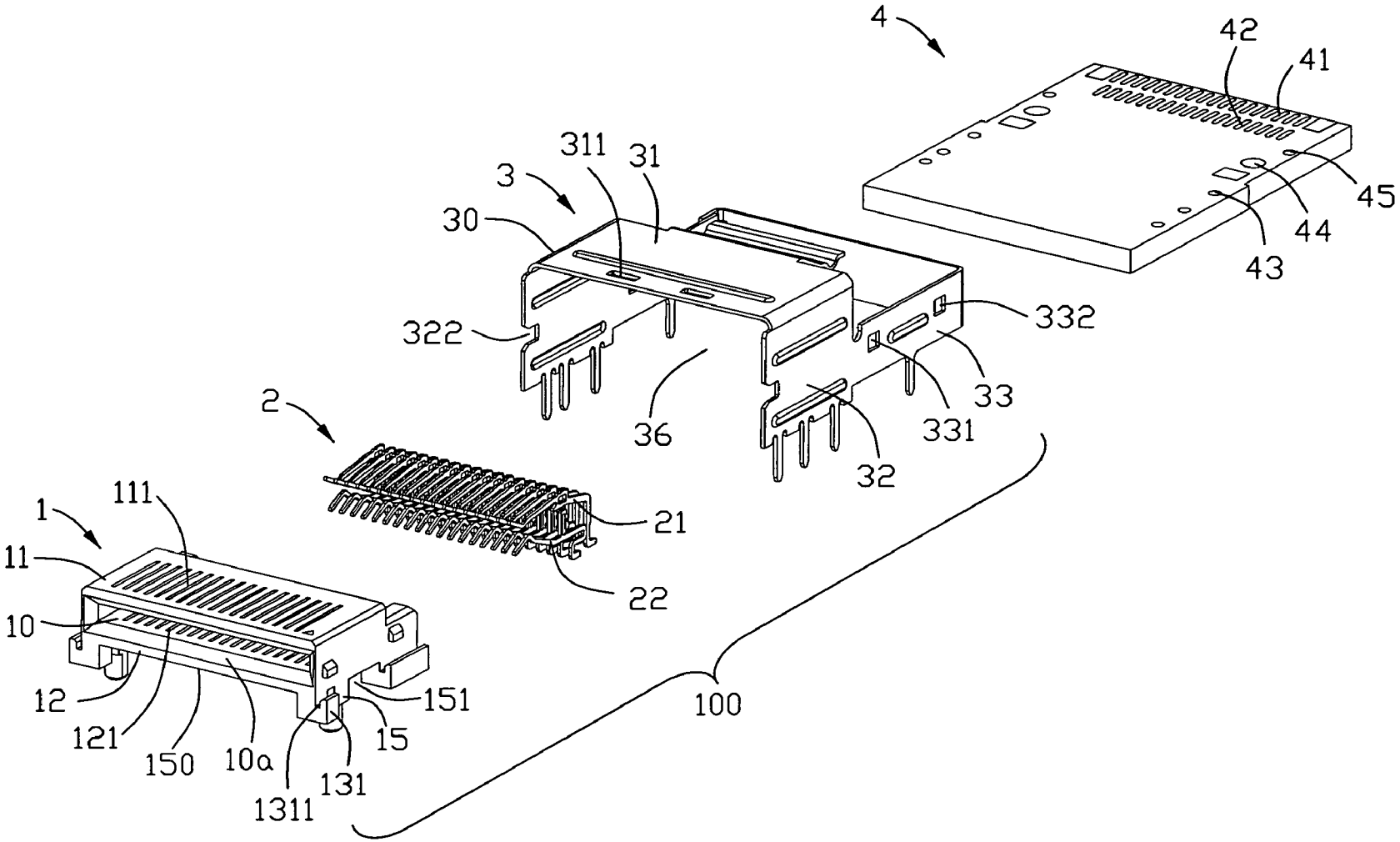
FIG. 1 is an exploded, perspective view of an electrical connector in accordance with the present invention.
Figure 2:
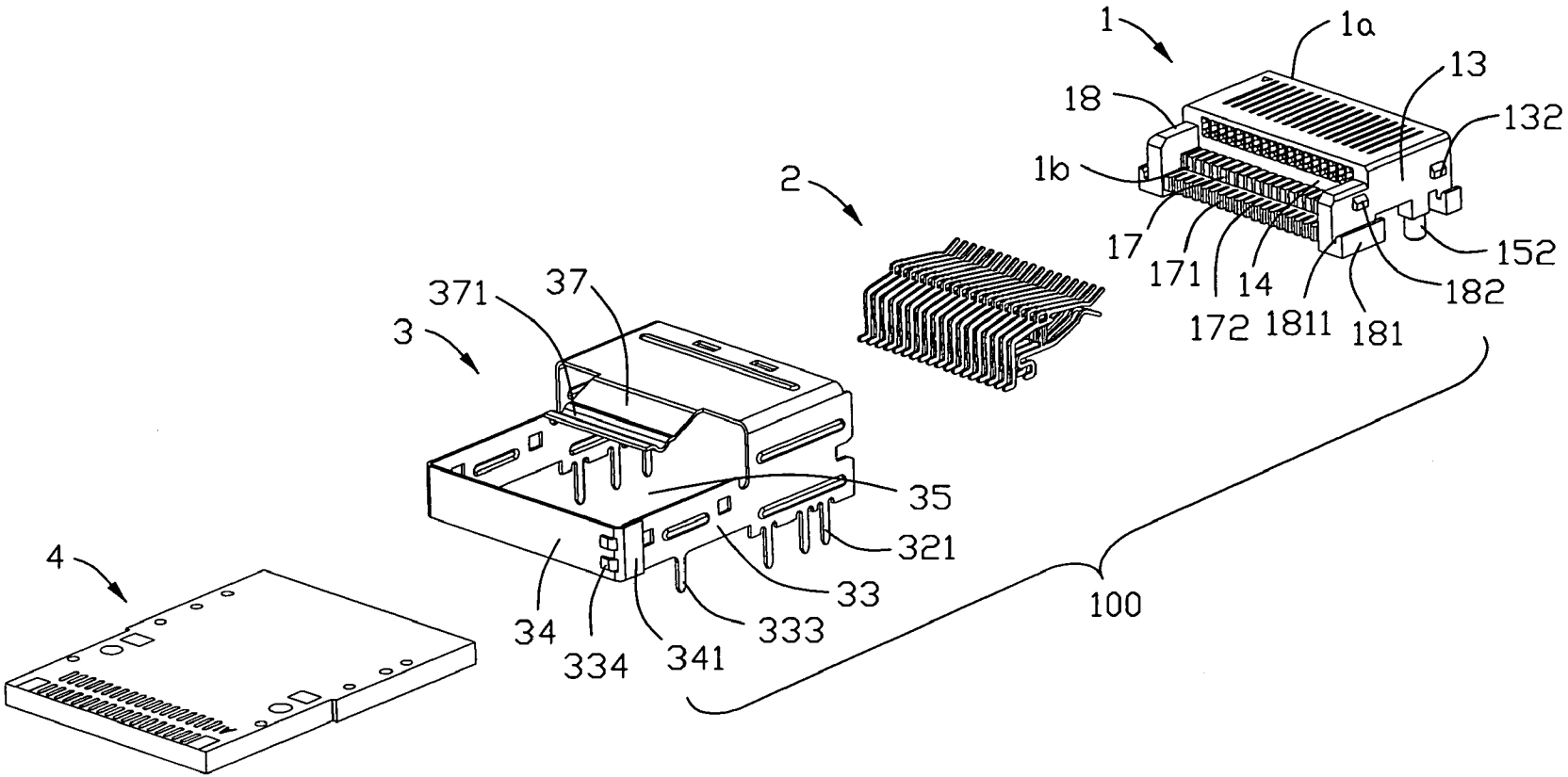
FIG. 2 is a view similar to FIG. 1, but viewed from another aspect.
Figure 3:
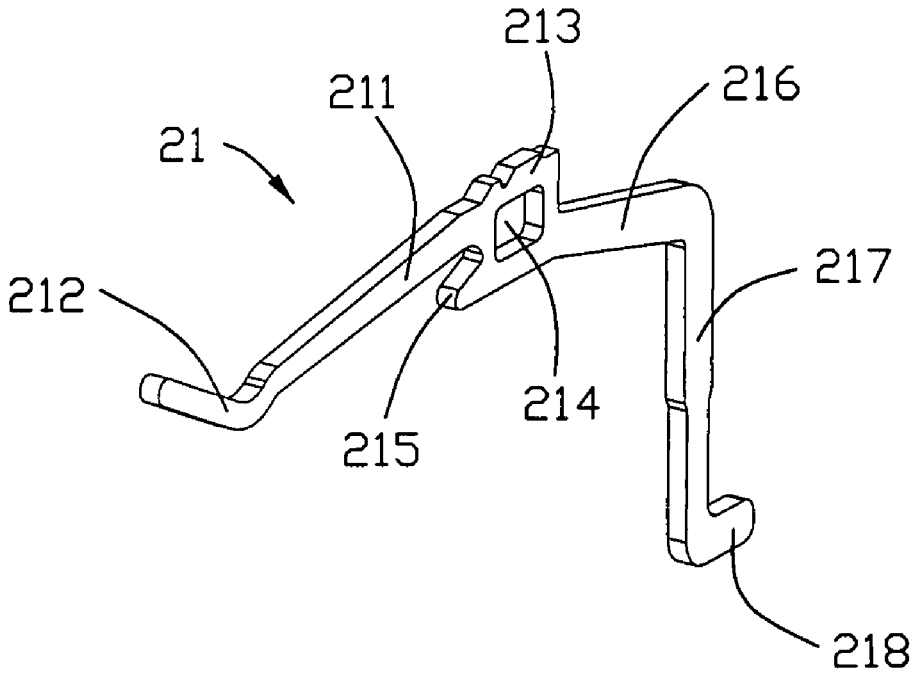
FIG. 3 is an enlarged view of terminals of the electrical connector.
Figure 3:
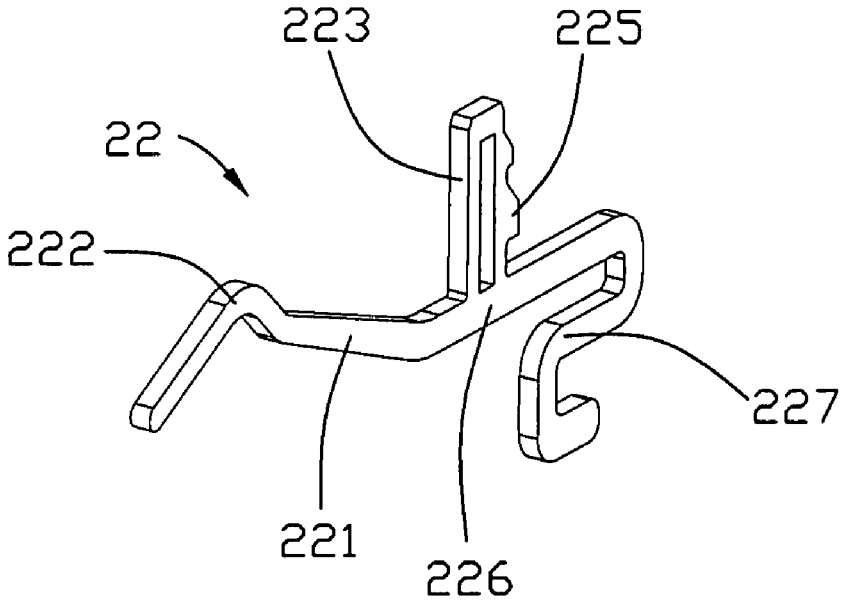
Figure 4:
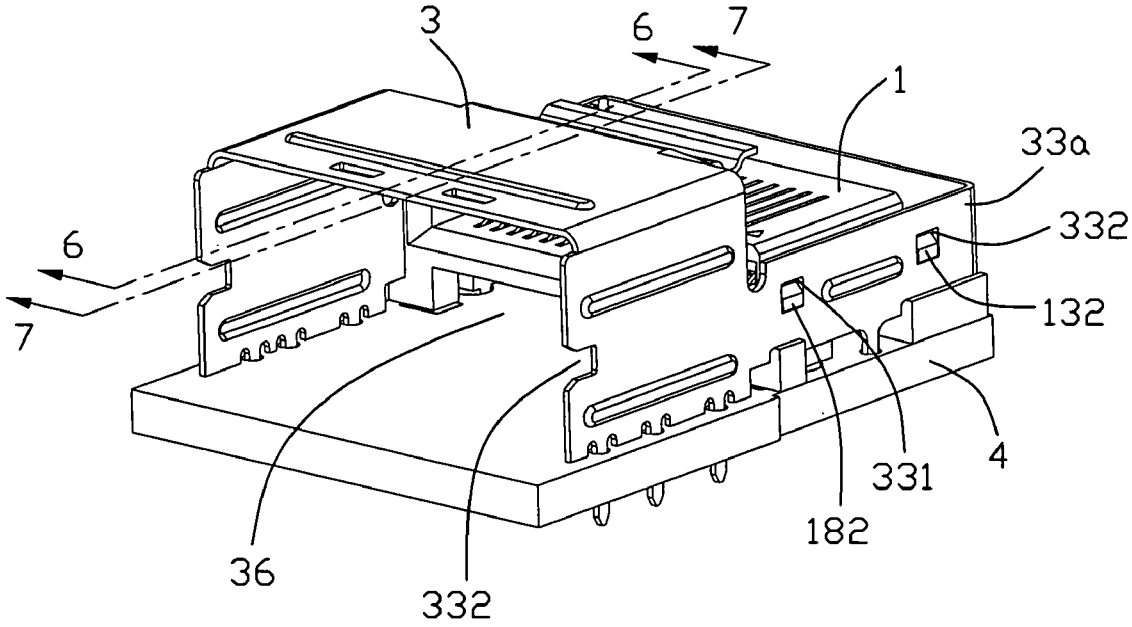
FIG. 4 is an assembled, perspective view of the electrical connector.
Figure 5:
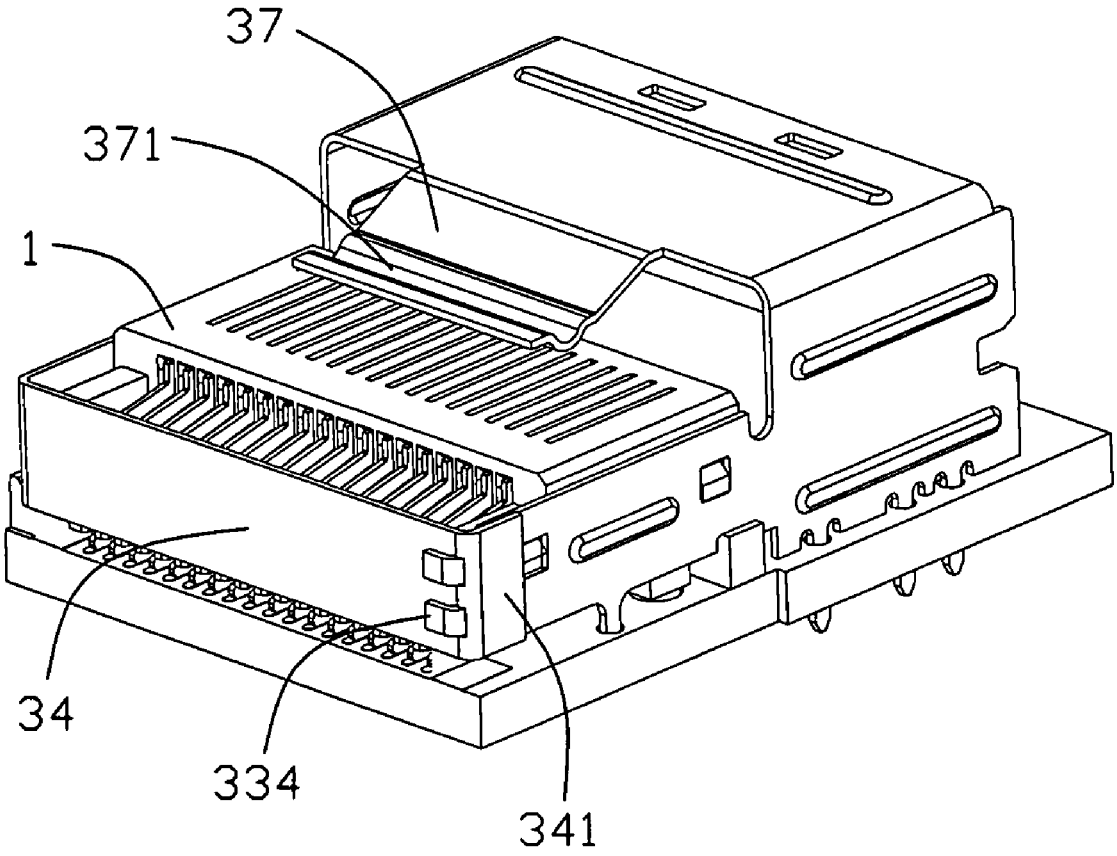
FIG. 5 is an assembled, perspective view of the electrical connector similar to FIG. 4, but viewed from different aspect.
Figure 6:
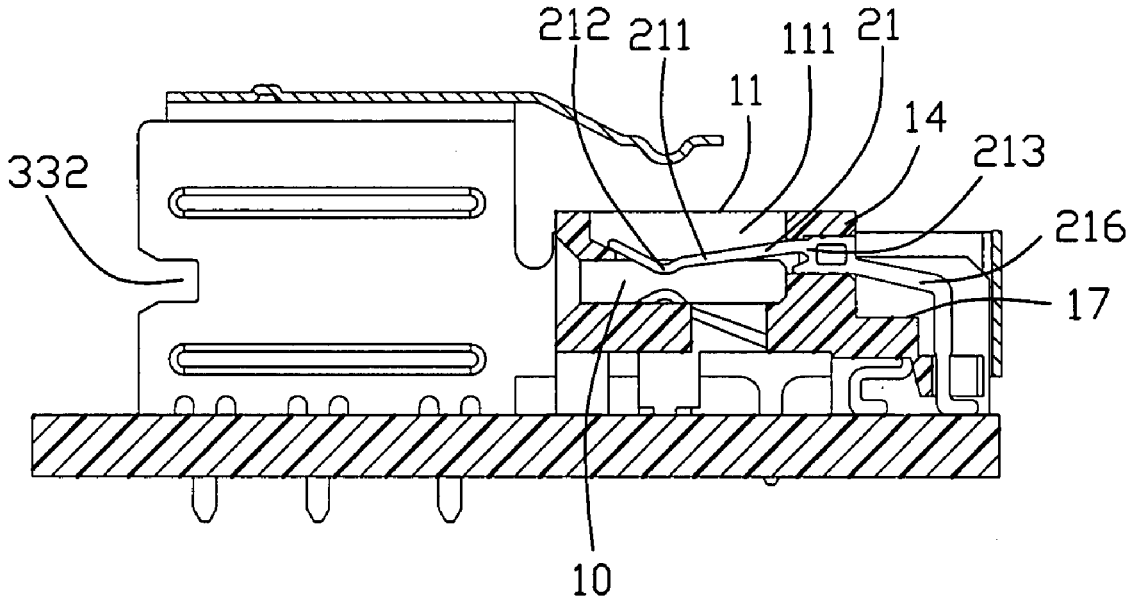
FIG. 6 is a cross-section view taken along line 6-6.
Figure 7:
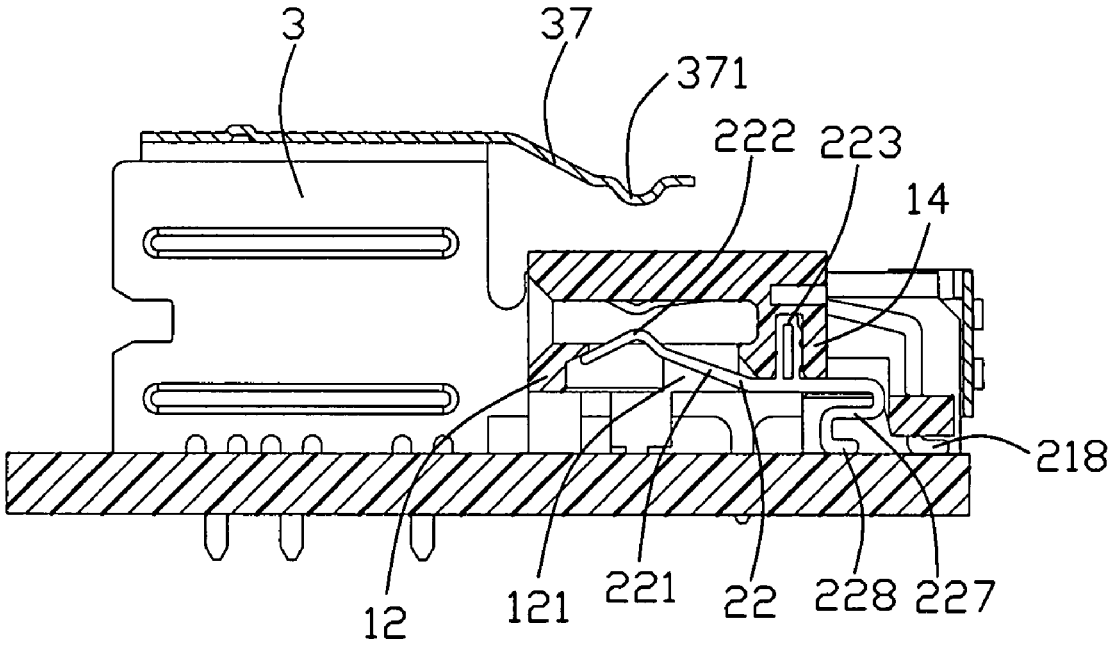
FIG. 7 is a cross-section view taken along line 7-7.

Referring to FIGS. 1-3, an electrical connector 100 for mounting on a circuit substrate 4 in accordance with the present invention comprises an insulated housing 1, a plurality of terminals 2 received in the insulated housing 1, and a metal shell 3 combined with the insulated housing 1.

The insulated housing 1 has a primary body portion 1*a* comprising a top wall 11, a bottom wall 12, a rear wall 14 and a pair of side walls 13 interconnecting with the top wall 11, the bottom wall 12 and the rear wall 14 to cooperatively enclose a hollow portion 10. The hollow portion 10 has an enlarged front opening 10*a* extending interiorly along a mating direction. Both the top wall 11 and the bottom wall 12 define a number of terminal slots 111, 121 interiorly recessed from an upper surface of the top wall 11 and a lower surface of the bottom wall 12 to communicate with the hollow portion 10. The terminal slots 111, 121 are arranged in two rows along transversal direction and offset from each other. Each side wall 13 forms a locking member 132 located on forward and middle outer surface thereof. A front section of each side wall 13 further forms a first bulge 131 laterally extend outward from a lower surface thereof. Thus, a first groove 1311 is formed between the first bulge 131 and the side wall 13. Two supporting members 15 respectively align with the pair of side walls 13 and extend downward from lateral sides of a bottom of the bottom wall 12. Thus, the bottom wall 12 and the two supporting members 15 consist of a passage way 150 along mating direction. A rear section of each supporting members 15 is cut to form a gateway 151. Two positioning posts 152 are respectively adjacent to the gateways 151 and extend downward from bottom surfaces of two supporting member 15.

The insulated housing 1 further has a secondary body portion 1*b* connecting to a back face of the primary body portion 1*a*. The secondary body portion 1*b* includes a pair of protection walls 18 respectively extending rearward from back edges (not numbered) of the pair of the side wall 13 of the primary body portion 1*a* and step-shaped platform portion 17 disposed between the protection walls 18 and extending rearward from lower section of the back face of the primary body portion 1*a*. Each protection wall 18 forms a second bulge 181 laterally extend outward from a lower surface thereof. Therefore, a second groove 1811 is formed between the second bulge 181 and the protection wall 18. The second groove 1811 and the first groove 1311 align with each another along longitudinal direction (mating direction). Each protection wall 18 further forms a locking member 182 located on forward and top outer surface thereof. A lower portion 171 of the platform portion 17 defines a number of gaps 172 arranged in a row along transversal direction.

Referring to FIG. 3, the terminals 2 comprise a plurality of first set of terminals 21 and second set of terminals 22 arranged in two distinct rows along vertical direction. Either of the first set of terminals 21 or the second set of terminals 22 is aligned in a row along transversal direction. Each of the first set of terminals 21 includes a forward and downward slant contact beam 211 with a curved contact portion 212 formed at a forward end thereof, an expanded retention portion 213 formed at a back end of the contact beam 211, a transition portion 216 slightly inclined extending rearward and downward from a lower section of an end edge of the retention portion 213 and a vertical leg portion 217 downward extending from an end of the transition portion 216 and a foot portion 218 bent rearward at angle about ninety degree to the vertical leg portion 217. The retention portion 213 of each of the first set of terminals 21 further has a rectangular-shaped adjusting hole 214 therein and a tapered protrusion portion 215 formed at lower edge of a forward end of the retention portion 213 and spaced apart from the contact beam 211 at a certain angle.

Each of the second set of terminals 22 includes a forward and upwardly slant contact beam 221 with a curved contact portion 222, a horizontal transition portion 226 extending rearward from an end portion of the contact beam 221, an upright retention portion 223 formed at middle section of the transition portion 226, an inverted zigzag-shaped supporting portion 227 with its top end portion engaging with an end portion of the transition portion 226. The inverted zigzag-shaped supporting portion 227 has a horizontal foot portion 228 stretching backward therefrom. The retention portion 223 is substantially rectangular-shaped with a vertical slot 224 therein and barbs 225 formed on a lateral side thereof. A configuration of the zigzag-shaped supporting portion 227 can control impedance of the terminal 22 and further improve electrical performance of signal transmission.

The metal shell 3 comprises an upper wall 31 and a pair of transversal walls 32 connecting with the upper wall 31 to form a substantially an inverted U-shape body portion 30. The inverted U-shape body portion 30 circumferences a roomage 36 therein adapted for leading the insertion of a complementary connector (not shown). A pair of lateral arms 33 respectively extend rearward from lower sections of back edges of the transversal walls 32 and a subsidiary arm 34 joined to the pair of lateral arms 33 to form a substantially U-shaped frame portion 33*a* with a forward outlet (not numbered). In the preferred embodiment, the subsidiary arm 34 is configured to L-shaped structure which has a longer transversal section (not numbered) integrated with an end section of one lateral arm 33 (left lateral arm, see FIG. 2) and a shorter longitudinal section (not numbered) overlapping with an end section of the other lateral arm 33 (right lateral arm, see FIG. 2). The lateral arm 33 (right lateral arm, see FIG. 2) also forms pair of hooks 334 latch with the subsidiary arm 34. Thus, the subsidiary arm 34 may be combined with the lateral arm 33 reliably. However, other means used for coupling the lateral arm 33 to the subsidiary arm 34, such as soldering, riveting etc. may be available. The frame portion 33*a* defines a space 35 thereamong, with a distance between the pair of lateral arms 33 substantially equal to a transversal dimension of the insulated housing 1. A spring member 37 slantways extending downward and rearward from middle part of rear edge of the upper wall 31 and a curved capturing portion 371 formed at lower section of the spring member 34. The capturing portion 371 is used to exert a downward force onto a mating portion of the complementary connector (not shown). A pair of locking apertures 311 for latching with latching portions of the complementary connector and a pair of cutouts 322 for guiding the insertion of the complementary connector are respectively defined on the front parts of the upper wall 31 and the transversal walls 32. Each cutout 322 is configured to substantially rectangular-type with a front opening. A pair of first through holes 331 are defined in the front part of the lateral arm 33 and a pair of second through holes 332 are defined in the relative front and rear parts of the lateral arm 33. Each transversal wall 32 has a triplet of board locks 321 respectively extending downwardly from the bottom edge thereof. A pair of grounding pins 333 are formed on the bottom edges of middle section of the pair of lateral arms 33, respectively.

The circuit substrate 4 has a plurality of conductive traces arranged in distinct first set of conductive traces 41 and second set of conductive traces 42. A pair of positioning holes 44 and three pairs of circular holes 43 are spaced arranged before the positioning holes 44 of the circuit substrate 4. Two conductive holes 45 rearward located on the circuit substrate 4.

Referring to FIGS. 4-7 in conjunction with FIGS. 1-3, when assembly, firstly, the first set of terminals 21 are assembled to the top wall 11 of the insulated housing 1 along a front-to-back (horizontal) direction, with the contact beams 211 disposed in the terminal slots 111, the contact portions 212 extending into the hollow portion 10, the retention portions 213 interferentially retained in an upper section of the rear wall 14, the transition portions 216 located above the platform portion 17, and lower sections of the leg portions 217 sandwiched in the gaps 172 of the platform portion 17. Secondly, the second set of terminals 22 are assembled to the bottom wall 12 of the insulated housing 1 along a vertical direction perpendicular to the front-to-back direction, with the contact beams 221 disposed in the terminal slots 121, the contact portions 222 extending into the hollow portion 10, the retention portions 223 inserted into a lower section of the rear wall 14, and zigzag-shaped supporting portion 227 exposed outside of a bottom surface of the platform portion 17.

Thirdly, the metal shell 3 is assembled to the insulated housing 1, with the insulated housing 1 accommodated in the space 35 of the frame portion 33*a*, partial of lower edges of the pair of lateral arms 33 sandwiched by the first grooves 1311 and the second grooves 1811, the first and the second locking members 132, 182 locked into the first and the second through holes 331, 332 of the pair of lateral arms 33 respectively, a rear surface of the insulated housing 1 abutting to and held by the subsidiary arm 34. Thus, the body portion 30 of the metal shell 3 is located forward of the front face of the insulated housing 1 and the spring member 37 of the metal shell 3 disposed above the top wall 11 of the insulated housing 1, with the capturing portion 371 of the spring member 37 aligning with contact portions 212, 222 of the first set and the second set of terminals 21, 22 along vertical direction. Fourthly, the insulated housing 1 and the metal shell 3 are together assembled to the circuit substrate 4, with the foot portions 218, 228 of the first set of and the second set of terminals 21, 22 respectively disposed on the conductive traces 41, 42, the positioning posts 152 received in the corresponding positioning holes 44, the board locks 321 inserted into the corresponding circular holes 43 for retaining the electrical connector 100 to the circuit substrate 4, and the grounding pins 333 received in the conductive holes 45 of the circuit substrate 4. Fifthly, the foot portions 218, 228 are soldered to the conductive traces 41, 42 by surface mount technology (SMT) manner. The gateways 151 of the side walls 13 of the insulated housing 1 facilitate the air flow in soldering process to improve the quality of solder. In the present invention, via the frame portion 33*a* coupled to the insulated housing 1, the metal shell 3 can withstand larger transversal force than before.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for mounting to a circuit substrate, comprising:

an insulated housing having a primary body portion including a top wall, a bottom wall and a pair of side walls interconnecting with the top wall and the bottom wall to cooperatively form a hollow portion;

a plurality of terminals arranged into two distinct sets and respectively supported by the top wall and the bottom wall of the insulated housing;

a metal shell including an upper wall and a pair of transversal walls extending downwardly from two opposite side edges of the upper wall to form a substantially inverted U-shaped body portion, said metal shell further having a pair of lateral arms extending rearward from rear edges of the transversal walls respectively and a subsidiary arm coupled to ends of the pair of lateral arms to form a substantially U-shaped frame portion;

wherein the insulated housing is securely assembled to the U-shaped frame portion, with the body portion of the metal shell located forwardly of the insulated housing; and a spring member slantways extending downward and rearward from rear edge of the upper wall and located above the insulated housing.

2. The electrical connector as claimed in claim 1, wherein the subsidiary arm extends from an end of one lateral arm along transversal direction and then engages with another lateral arm.

3. The electrical connector as claimed in claim 1, wherein the subsidiary arm is configured to L-shaped structure which has a longer transversal section integrated with an end section of one lateral arm and a shorter longitudinal section overlapped with an end section of the other lateral arm to form the U-shaped frame portion to hold the insulated housing.

4. The electrical connector as claimed in claim 1, wherein the pair of lateral arms further have a pair of grounding pins respectively formed on the bottom edges of middle sections thereof.

5. The electrical connector as claimed in claim 1, wherein the insulated housing further has two supporting members respectively aligning with the pair of side walls and extend downwardly from lateral sides of a bottom of the bottom wall, wherein the bottom wall and the two supporting members consist of passage way along a mating direction.

6. The electrical connector as claimed in claim 1, wherein each of the side walls of the primary body portion forms a first locking member locked into a first through hole of the lateral arm of the metal shell.

7. The electrical connector as claimed in claim 1, wherein the insulated housing further comprises a secondary body portion connecting to a back face of the primary body portion of the insulated housing.

8. The electrical connector as claimed in claim 7, wherein the secondary body portion includes a pair of protection walls respectively extending rearward from back edges of the pair of the side wall of the primary body portion and step-shaped platform portion disposed between the protection walls and extending rearward from lower section of the back face of the primary body portion.

9. The electrical connector as claimed in claim 8, wherein each of the protection wall forms at least one bulge extending outward from a lower surface thereof, wherein the bulge together with the side wall to form a groove sandwiching a bottom edge of corresponding arm.

10. The electrical connector as claimed in claim 1, wherein the first set of terminals and the second set of terminals are assembled to the insulated housing along different directions which are perpendicular to each other.

11. The electrical connector as claimed in claim 10, wherein the first set of terminals are assembled to the insulated housing along a horizontal direction and the second set of terminals are assembled to the insulated housing along a vertical direction.

12. The electrical connector as claimed in claim 10, wherein each of the first set of terminals comprises a contact beam with a curved contact portion formed at a forward thereof, a retention portion formed at a back end of the contact beam, a transition portion extending rearward from an end edge of the retention portion and a vertical leg portion downward extending from an end of the transition portion.

13. The electrical connector as claimed in claim 10, wherein each of the second set of terminals comprises a contact beam with a curved contact portion, a horizontal transition portion extending rearward from an end portion of the contact beam, an upright retention portion formed at middle section of the transition portion, a zigzag-shaped supporting portion with its top end portion engaging with an end portion of the transition portion.

14. An electrical connector located on a circuit substrate, comprising:

an insulated housing having a primary body portion including a top wall, a bottom wall and a pair of side walls interconnecting with the top wall and the bottom wall to cooperatively form a hollow portion;

a plurality of terminals arranged into two distinct sets and respectively supported by the top wall and the bottom wall of the insulated housing;

a metal shell including an upper wall and a pair of transversal walls extending downwardly from two opposite side edges of the upper wall to form a substantially inverted U-shaped body portion, said metal shell further having a pair of lateral arms extending rearward from rear edges of the transversal walls respectively and a subsidiary arm coupled to ends of the pair of arms to form a substantially U-shaped frame portion;

wherein the insulated housing is securely assembled to the U-shaped frame portion, with the inverted U-shaped body portion of the metal shell located forwardly of the insulated housing; and wherein the transversal walls of the metal shell further has a pair of cutouts with front openings for guiding a complementary connector inserting into the electrical connector.

15. The electrical connector as claimed in claim 14, wherein the pair of cutouts and the hollow portion of the insulated housing substantially lie on a horizontal geometrical plane.

16. The electrical connector as claimed in claim 14, wherein the metal shell further comprises a spring member slantways extending downward and rearward from rear edge of the upper wall, and wherein the spring forms a curved capturing portion at end portion thereof.

17. The electrical connector as claimed in claim 16, wherein the terminals are arranged into distinct rows and received in the terminal slots of the insulated housing and each terminal has a contact portion extending into hollow portion of the insulated housing, and wherein the capturing portion of the spring member of the metal shell aligns with the contact portions of the terminals along vertical direction.

18. An electrical connector assembly comprising:

a printed circuit board;

an electrical connector including:

an insulative housing self-mounted to the printed circuit board and defining a front mating face; and a metallic shell having essentially an upside-down first U-shaped configuration and a lying second U-shaped configuration linked to a rear face of said first U-shaped configuration, and self-mounted to the printed circuit board essentially in front of the housing under a condition that the housing is essentially located in the second U-shaped configuration; wherein the front mating face is essentially behind a rear face of the said first U-shaped configuration, and the housing is essentially located in said second U-shaped configuration.

19. The electrical connector assembly as claimed in claim 18, wherein the shell further includes a spring member rearwardly extending from an upper edge of the rear face thereof, while not beyond a rear wall of said second U-shaped configuration.

20. The electrical connector assembly as claimed in claim 19, wherein a height of said second U-shaped configuration is similar to that of the housing.

* * * * *